United States Patent [19]

Oppl

[11] Patent Number: 4,726,402

[45] Date of Patent: Feb. 23, 1988

[54] GEAR DRIVE FOR SHUTTLELESS LOOMS

[75] Inventor: Othmar Oppl, Hergensweiler, Fed. Rep. of Germany

[73] Assignee: Lindauer Dornier Gesellschaft mbH, Lindau, Fed. Rep. of Germany

[21] Appl. No.: 936,822

[22] Filed: Dec. 2, 1986

[30] Foreign Application Priority Data

Feb. 11, 1986 [DE] Fed. Rep. of Germany ..... 3604257

[51] Int. Cl.[4] ..... D03D 47/27

[52] U.S. Cl. ..... 139/449; 74/579 R; 74/594

[58] Field of Search ..... 139/441, 444, 445, 446, 139/449; 74/579, 594

[56] References Cited

U.S. PATENT DOCUMENTS

| | | | |
|---|---|---|---|
| 1,957,024 | 5/1934 | Klemm | 139/449 |
| 3,192,958 | 7/1965 | Brimans et al. | 139/449 |
| 3,364,954 | 1/1968 | Kokkinis | 139/122 |
| 3,877,350 | 4/1975 | Earley et al. | 74/579 R |
| 4,408,380 | 10/1983 | Schaper et al. | 74/579 |

FOREIGN PATENT DOCUMENTS

| | | | |
|---|---|---|---|
| 77087 | 4/1983 | Belgium | 139/449 |
| 2315558 | 1/1977 | France . | |
| 15540 | 1/1984 | Japan | 139/449 |
| 2177429 | 1/1987 | United Kingdom | 139/449 |

*Primary Examiner*—Henry S. Jaudon

*Attorney, Agent, or Firm*—W. G. Fasse; D. H. Kane, Jr.

[57] ABSTRACT

A gear drive for a shuttleless loom having a coupling train between a power input shaft and a power output member for reciprocating a weft thread gripper device into and out of a loom shed. The coupling train has a gear lever journalled for an oscillating motion which transports the weft thread gripper device. The coupling train also includes a piston rod type coupling link between the power input shaft and the gear lever. One end of the piston rod is journalled by a crank pin to the power input shaft. The other end of the piston rod is connected to a fork of the gear lever by a journal bolt having wedge type teeth and grooves in its facing ends which cooperate with respective teeth and grooves in the fork for an adjustment of the coupling point between the piston rod and the gear lever along elongated guide slots in the fork of the gear lever. The guide slots and wedge type teeth and grooves have the shape of a circular arc having its center of curvature on a line extending in parallel to the rotational axis of the power input shaft and through an end point of the motion of the crank pin. This arrangement permits a precise adjustment of the stroke of the weft thread gripper device and transmits substantial forces without problems.

8 Claims, 2 Drawing Figures

GEAR DRIVE FOR SHUTTLELESS LOOMS

FIELD OF THE INVENTION

The invention relates to a gear drive for shuttleless looms in which a weft thread gripper reciprocates into and out of a loom shed for transporting the weft thread into the loom shed or through the loom shed. Two such grippers on their respective gripper rods may cooperate in the transporting of the weft thread.

DESCRIPTION OF THE PRIOR ART

Weft thread insertion or transport mechanisms of the prior art comprise, for example, long stiff rods which reciprocate into and out of the loom shed. It is also known to transport the weft thread grippers with the aid of flexible belts to which the gripper head is attached for seizing and transporting the weft thread. Meshing gear teeth cooperate for moving the gripper rods. Gear teeth and a row of holes also cooperate for transporting the flexible gripper carrying belts. The specific construction of the gearing for transporting the gripping mechanisms may vary. For example, the rigid gripper rods may be equipped with a toothed rack embedded in a U-sectional hollow rod. On the other hand, the flexible gripper transport belts may be secured to large drums or disks which oscillate back and forth. Due to the oscillating movement of these drums or disks, the flexible belts are wound onto the drum on the return stroke and reeled off the drum on the forward stroke. The belts are provided with holes or perforations arranged in a row for cooperation with the teeth of a drive pinion. The back and forth rotation of the drive pinion in opposite rotational directions in an alternate fashion is derived from the main drive of the loom.

U.S. Pat. No. 3,364,954 describes a drive for a rigid gripper head carrying rod in which the toothed rack forms part of the hollow rail forming the gripper rod. In such a drive system for the gripper rod or for the gripper carrying flexible belts, it is customary that the rotational axis of the main drive shaft and the rotational axis of the drive pinion for the rod or belt extend at right angles to each other. As a result, it is usually necessary to provide a gear drive which translates the power input from one axial direction to the power output in another axial direction extending perpendicularly to the first mentioned axial direction.

It may also be desirable to provide a step down gearing between the main drive shaft, or rather between the rotational movements of the main drive shaft and the drive pinion of the weft thread insertion members.

It is also desirable that the same loom can be set up for weaving fabrics of different widths. For this purpose it is necessary to adjust the reciprocating stroke of the weft thread insertion members. It is known in this connection to use a lever arm which is adjustable in its length by adjustment of the coupling point of a coupling element between a member which derives the oscillating rotational movement from the main drive shaft for transmission to the pinion which drives the weft thread insertion member or members. Such lever arm may, for example, be a lever, one end of which is provided with a gear segment.

French Patent Publication No. 2,315,558 discloses such a gear segment lever which is provided with an elongated hole for the adjustment of its stroke. The coupling point between the gear segment lever and a coupling element is displaceable within the elongated hole and may be fixed in an adjusted position within the elongated hole. The elongated adjustment hole in this French Patent Publication No. 2,315,558 is a straight hole extending substantially radially, whereby an error is caused in the weft thread transfer in the center of the loom shed because the operational motions in this phase of a work cycle go on differently due to this straight hole. As a result, it is necessary to compensate for this error by a new adjustment for each new set-up of the loom for weaving a different fabric width.

The above described devices for the weft thread insertion must be capable of transmitting substantial forces. Therefore, it is necessary to assure a safe connection of the coupling element in the coupling point of the elongated hole of the gear segment lever. Such a safe connection requires large frictional surfaces for the respective clamping components. This requirement of large frictional surfaces conflicts with the limited available space and with the requirement that the masses to be moved should be as small as possible. Further, in a substantially continuously operating loom fretting corrosion must be avoided at the connecting points in spite of the large forces being transmitted. On the other hand, the adjustment of the coupling element in the elongated hole of the gear segment lever shall be easily accomplished when the clamping action is released. In spite of such easy adjustment, it must be possible to precisely pinpoint the coupling point in its adjusted position. Furthermore, it must be assured that once the adjustment has been made, it must not be disturbed by the loosening and/or tightening of the clamping screw of the clamping mechanism. Yet another important requirement is seen in that the gear segment lever must retain its end position when the stroke of the weft thread insertion members is adjusted. In other words, the end position of the gear segment lever must not be changed by the stroke adjustment. Preferably, this end position of the gear segment lever corresponds to the position of the weft thread insertion members at the time of thread transfer in the center of the shed of the loom. This transfer portion should be fixed.

OBJECTS OF THE INVENTION

In view of the foregoing it is the aim of the invention to achieve the following objects singly or in combination:

to provide a gear drive for shuttleless looms which requires few parts and hence may be as simple as possible;

to provide a gear drive for a power transmission of the type described wherein an end position of the gripper rod stroke remains fixed, and wherein large forces may be transmitted without causing a change in the gripper rod stroke length by these large forces once the stroke length has been adjusted;

to assure, in spite of the simplicity of the power transmission drive, its trouble-free function, especially its trouble-free stroke adjustment for the insertion of the weft thread even where large forces must be accommodated; and to make particularly sure that the adjustment of the coupling member will not be disturbed when the clamping means are released and/or tightened.

SUMMARY OF THE INVENTION

According to the invention the gear drive for the thread insertion in a shuttleless loom has the following features. The weft thread gripper device or means for transporting a weft thread through a loom shed may comprise a power output member which is operated by a gear lever having a gear segment and a fork section mounted on a journal shaft for a back and forth tilting or rocking movement. The gear lever is operated by a coupling link which in turn is connected to an oscillating power input shaft by a crank pin. The coupling link is constructed as a type of piston rod, one end of which is journalled to the oscillating power input shaft by said crank pin. The other end of the coupling link is adjustably journalled by a journal bolt to the fork section of the gear lever. The fork section of the gear lever provides two shear zones between the fork section and the journal bolt. The journal bolt is rotatably supported in the other end of the piston rod and has a diameter larger than the width of longitudinal guide slots in the fork section. The end faces of the journal bolt and inner surfaces of the fork section facing the bolt end faces have cooperating wedge type teeth and grooves. Preferably these teeth and grooves are provided on both sides of the guide slots. The wedge type teeth and grooves and the guide slots have a curved shape extending along circular arcs having centers of curvature located on a common axis extending through said crank pin in one of its end positions at the end of an oscillatory movement of the power input shaft about the oscillation or rotational axis of the power input shaft, whereby the common axis on which the centers of curvature are located and the oscillation axis extend in parallel to each other. A clamping device, such as a threaded bolt extending axially through the journal bolt and through the guide slots in the fork section, and a nut on the threaded bolt, can fix the journal bolt in any position along the guide slots. The journal bolt is adjustable into any position along the guide slots when the nut is loosened.

By constructing the guide slots and the teeth and grooves at the end of the journal bolt and in the side plates forming the fork section of the gear lever so that they have a circular arc configuration, and by making sure that the center of curvature of the guide slots and the teeth and grooves is located on an axis through the rotational center of the piston rod, it is assured that one end position of the gear lever has a fixed location at all times independently of any stroke adjustment for the weft thread insertion devices. It follows, that one end of the stroke of the weft thread insertion devices is also fixed. By providing the facing ends of the journal bolts, and the respective surfaces of the side plates forming the fork section of the gear lever with the mentioned wedge type teeth and grooves, an increased friction surface is obtained without increasing the space or volume needed for the gear drive. Simultaneously, the specific surface load or stress caused by the clamping forces and the operational forces to be transmitted are reduced. These features in turn prevent the so-called fretting corrosion. A very tight connection, and thus precise locating of the journal bolt anywhere along the guide slots is assured by the teeth and grooves which are effective with a wedge action on the side plates of the fork section and on the journal bolt when the clamping screw is tightened. Moreover, the cooperation of the teeth and grooves provides a form-locking connection between the side plates of the fork section and the journal bolt, whereby an easy and precise adjustability is assured. Simultaneously, an unintended displacement of the journal bolt in the guide slots is prevented even if the clamping screw is loosened. Yet another advantage is seen in the fact that the position of the journal bolt is not changed by the loosening or tightening of the clamping screw.

BRIEF DESCRIPTION OF THE DRAWINGS

In order that the invention may be clearly understood, it will now be described, by way of example, with reference to the accompanying drawings, wherein.

Figure 1:
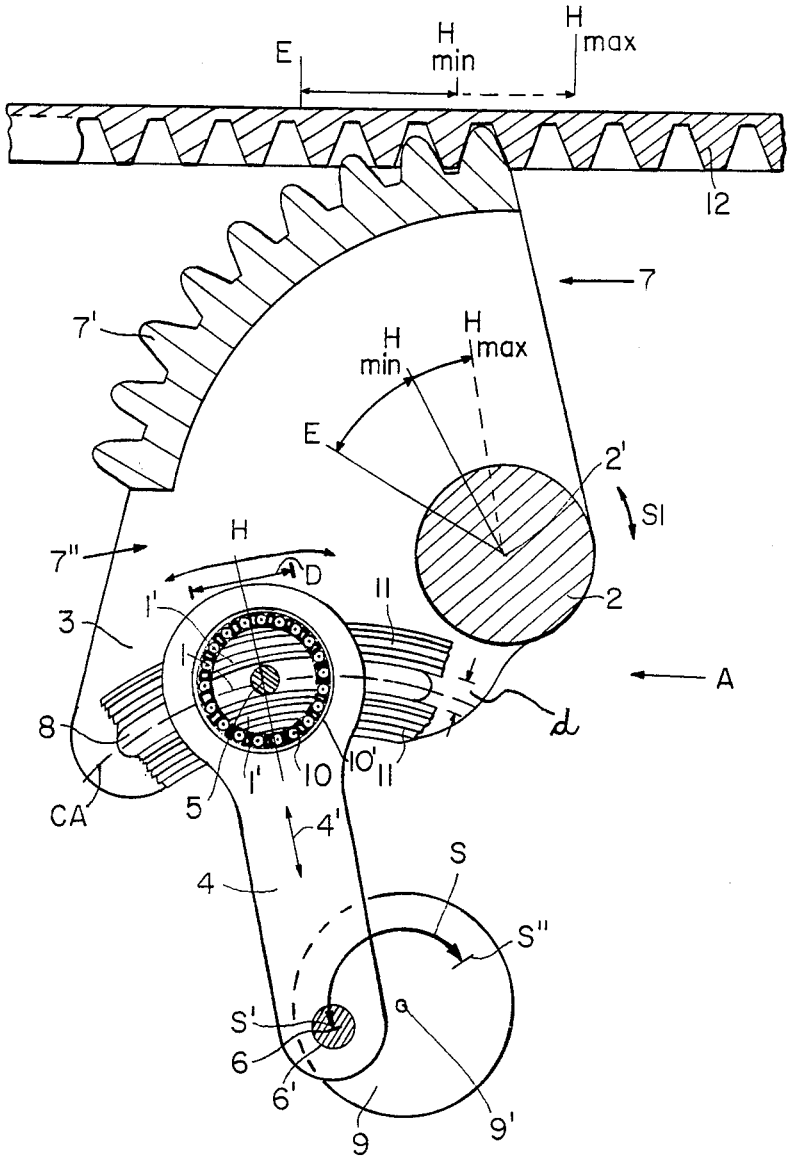
FIG. 1 is a view, partially in section, along the section plane I—I in FIG. 2.

DETAILED DESCRIPTION OF PREFERRED EXAMPLE EMBODIMENTS AND OF THE BEST MODE OF THE INVENTION

The drawings show only those components required for the understanding of the invention. The above mentioned U.S. Pat. No. 3,364,954 (Kokkinis) and French Patent Publication No. 2,315,558 provide sufficient background information for placing the present gear drive into a loom between the main drive shaft of a loom and the mechanism for inserting the weft thread into the loom shed.

A power output member such as a toothed rack 12 transmits the driving power to the weft thread insertion device such as a gripper rod. The toothed rack 12 may itself be part of the gripper rod as disclosed in U.S. Pat. No. 3,364,954 (Kokkinis). For this purpose the toothed rack 12 reciprocates back and forth in response to the oscillating movement of power coupling means connecting the rack 12 to a power input drive shaft such as a crank type drive shaft 9. The crank type drive shaft 9 oscillates back and forth about its oscillation axis 9' as indicated by the double arrow S The driving of the crank shaft 9, or rather its oscillating motion, is caused by conventional means not shown. For example, an eccentric cam follower may oscillate the shaft 9 back and forth as indicated by the double arrow S between two end points S' and S".

The power coupling means between the crankshaft 9 and the rack 12 comprise, according to the invention, a gear lever 7 and a coupling link 4 in the form of a piston rod. The piston rod 4 has a first end journalled to the crankshaft 9 by a crank pin 6. An axis 6' extends through the end point S' and in parallel to the oscillation axis 9' of the crankshaft 9. When the crank pin 6 is in its end position S', the journal axis of the crank pin 6 will coincide with the common axis 6' and with the end point S'. Due to the oscillating movement indicated by the arrow S, the piston rod 4 will move up and down as indicated by the double arrow 4'.

The piston rod 4 has a second or upper end which is operatively connected to the gear lever 7. The gear lever 7 has a gear segment 7' and a fork section 7". The fork section 7" comprises two side plates 3 which are spaced from each other to rigidly hold the gear segment 7' between the two side plates 3, please see FIG. 2. The gear lever 7 is mounted with its side plates 3 on a journal shaft 2 having a journal axis 2' about which the gear lever 7 can oscillate back and forth as indicated by the double arrow S1. The journal shaft 2 is mounted in the loom housing not shown. The shaft 2 may actually be realized by two journal studs extending laterally away from the respective side plate 3.

Figure 2:
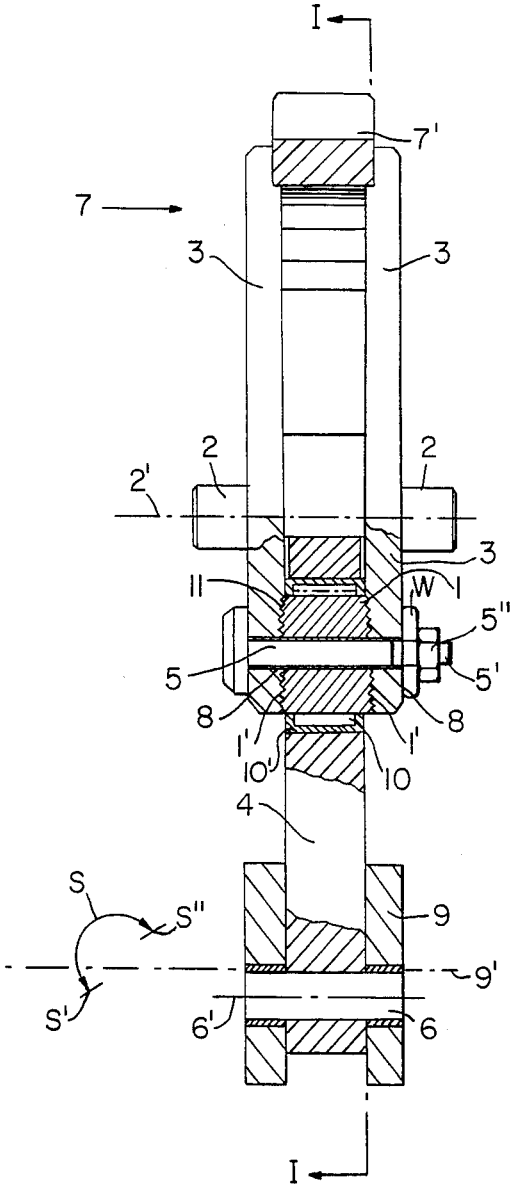
FIG. 2 is a side view, partially in section, of FIG. 1 as viewed in the direction of the arrow A in FIG. 1.

The connecting means for operatively securing the upper or second end of the piston rod 4 forming the coupling link to the gear lever 7 comprise a journal bolt 1 secured through a journal bearing, preferably a needle bearing 10 in a respective hole 10' in the upper end of the piston rod 4 and a clamping screw bolt 5 having a threaded end 5' cooperating with a nut 5". The journal bolt 1 has a through-bore through which the clamping bolt 5 extends as best seen in FIG. 2. The clamping bolt 5 further extends through two elongated guide slots 8, one of which is provided in each of the side plates 3 of the gear lever 7. When the nut 5" is tightened against the washer W, the journal bolt is clamped between the lower surfaces of the side plates 3. For enhancing this clamping action and for keeping the journal bolt 1 in place even if the clamping nut 5" should be loosened, the invention provides the lateral end faces of the journal bolt 1 with a first set of teeth and grooves 1'. Additionally, the inwardly facing surfaces of the side plates 3 are also provided with a second set of teeth and grooves 11. Both sets of teeth and grooves 1' and 11 perform a wedging action as will be described in more detail below. In order to provide the end faces of the journal bolt 1 with the teeth and grooves 1' the journal bolt 1 has a diameter D which is larger than the width d of the guide slots 8 so that the journal bolt has end faces projecting outside said guide slots. This is best seen in FIG. 1. Additionally, the guide slot has a curved shape extending along a circular arc CA having its center of curvature in the end point S' and thus on the common axis 6'. As shown in FIG. 1, the teeth and grooves 1' and 11 also have concentric circular arc curvatures with centers of curvature on the common axis 6'. The elongated slot 8 have a length along the circular arc CA which is determined by the desired stroke adjustment. It has been found that an adjustment range of about 60% to 100% of the required maximum stroke is satisfactory in practice.

As best seen in FIG. 2, due to the two side plates 3 of the gear lever 7, the clamping bolt 5 will be exposed to a shearing load at two locations, thereby reducing the shearing stress to be transmitted at each location. Due to the action of the clamping bolt 5 and the clamping nut 5" the side plates 3 act as a clamping body. Due to this arrangement and due to the cooperating set of teeth and grooves 1', 11, the force that can be transmitted is substantially larger than the clamping force to be exerted by the bolt 5 and the nut 5" alone.

Preferably the set of teeth and grooves 1' and 11 are provided above and below the guide slot 8 as shown in FIG. 1.

As best seen in FIG. 1 the journal bolt 1 can easily be displaced along the curved guide slot 8 when the clamping nut 5" is loosened. Thus, the stroke of the gear lever 7 is adjustable as indicated by the double arrow H. Corresponding stroke angles are indicated between the end point E and minimum and maximum strokes $H_{min}$ and $H_{max}$ also as shown in FIG. 1 above the journal axis 2' of the journal shaft 2.

The power output of the gear lever 7 may be constructed differently than as shown in FIGS. 1 and 2. For example, intermediate gears, not shown since known, may be employed between the gear lever 7 and the rack 12 for providing the required transmission ratio. The end position of the rack 12 is also shown at E and the minimum and maximum strokes are again shown at $H_{min}$ and $H_{max}$ in FIG. 1 above rack 12.

When used in connection with looms in which a gripper head carrying rod is arranged on each side of the loom, each of these rods will be provided with a gear drive according to the invention, and one gear drive will be a mirror image of the other.

Due to the curvature of the sets of teeth and grooves 1' and 11, the invention insures that an easy adjustment is possible without any follow-up adjustment. Due to the location of the center of curvatures as disclosed herein it is assured that the one end position of the weft thread insertion means is always defined in a fixed location. The sets of teeth and grooves 1', 11 provide a large frictional surface, whereby, tightening of the nut 5" transmits substantial forces without any difficulties. Even if the nut 5" is loosened, the journal bolt 1 will retain its position, yet it can be easily adjusted manually into the desired position, whereupon the nut 5" is tightened again.

Although the invention has been described with reference to specific example embodiments, it will be appreciated, that it is intended to cover all modifications and equivalents within the scope of the appended claims.

What I claim is:

1. A gear drive for a shuttleless loom, comprising an oscillatable input drive means for providing a driving power, a reciprocating power output member for moving a weft thread gripper device into and out of a loom shed, power coupling means for transmitting drive power from said power input drive means to said power output member, said power coupling means comprising a coupling link having a first end and a second end, a crank pin eccentrically connecting said first end of said coupling link to said power input drive means, a gear lever comprising a fork section and a gear segment arranged for driving said reciprocating power output member, a journal shaft for tiltably mounting said gear lever, connecting means for operatively connecting said second end of said coupling link to said fork section of said gear lever, said fork section of said gear lever having elongated guide slots with a given slot width (d) to which said connecting means are operatively connected, said guide slots extending along a circular arc having its center of curvature in an oscillation end point of said crank pin of said power input drive means for guiding an adjustment movement of said coupling link, said connecting means comprising a journal bearing including a journal bolt comprising end faces and having a diameter (D) larger than said given slot width (d) so that said journal bolt end faces project outside said width (d) of said guide slots, a first set of wedge type teeth and grooves in said end faces of said journal bolt, said fork section having inner surfaces facing said end faces of said journal bolt, said inner surfaces having a second set of wedge type teeth and grooves cooperating with said first set of wedge type teeth and grooves of said bolt end faces, said first and second sets of wedge type teeth and grooves extending along circular arcs concentric with said guide slots, said connecting means further including clamping means for securing said journal bolt in said fork section, so that said first and second sets of wedge type teeth and grooves engage each other for fixing the position of said journal bolt relative to said gear lever while permitting a relative rotation between said gear lever and said coupling link about said journal bolt.

2. The gear drive of claim 1, wherein said power input drive means comprise a crankshaft type drive shaft.

3. The gear drive of claim 1, wherein said fork section of said gear lever comprises two side plates (3) cooperating with said clamping means in holding said gear segment (7') and said journal bolt between said two side plates.

4. The gear drive of claim 1, wherein said coupling link is constructed as a piston rod.

5. The gear drive of claim 1, wherein said journal bearing means are operatively interposed between said journal bolt and said second end of said coupling link for permitting said relative rotation.

6. The gear drive of claim 5, wherein said journal bearing means comprise a needle bearing, said journal bolt passing through said needle bearing.

7. The gear drive of claim 1, wherein said first and second sets of wedge type teeth and grooves extend above and below said elongated guide slots.

8. The gear drive of claim 1, wherein said journal bolt comprises an axial through-bore, said clamping means comprising a clamping screw bolt (5) extending through said through-bore and through said guide slots.

* * * * *